United States Patent [19]

Matoba et al.

[11] 4,227,921

[45] Oct. 14, 1980

[54] METHOD OF CONTROLLING A BLAST FURNACE OPERATION

[75] Inventors: Yoshiyuki Matoba; Koichi Otsuka, both of Amagasaki, Japan

[73] Assignee: Sumitomo Kinzoku Kogyo Kabushiki Kaisha, Osaka, Japan

[21] Appl. No.: 11,617

[22] Filed: Feb. 12, 1979

[30] Foreign Application Priority Data

Feb. 27, 1978 [JP] Japan ..... 53-22454

[51] Int. Cl.[3] ..... C21B 5/00

[52] U.S. Cl. ..... 75/41; 266/44

[58] Field of Search ..... 75/41, 42; 266/44, 80

[56] References Cited

U.S. PATENT DOCUMENTS 3,719,811 3/1973 Munson ..... 75/41

*Primary Examiner*—M. J. Andrews

*Attorney, Agent, or Firm*—Ladas & Parry

[57] ABSTRACT

This invention relates to a method of controlling blast furnace operation by manipulating the following variables: oil injection rate, blast moisture, blast oxygen rate, blast rate blast temperature and ore/coke ratio.

7 Claims, 10 Drawing Figures

METHOD OF CONTROLLING A BLAST FURNACE OPERATION

This invention relates to a method of controlling blast furnace operation and, more particularly, one characterized by predicting the deviation in temperature of the burden or pig iron or Si content of the pig iron by using a process model and altering manipulating variables in accordance with the difference between the target value and the predicted value.

In order to maintain steady and stable operation of a blast furnace, it is required to appropriately control the burden temperature, particularly the temperature of the pig iron or Si content of the pig iron.

Since the temperature or Si content of the pig iron can be measured only intermittently, it has hitherto been conventional practice to control the operation by using a thermal index which is valid at that particular time as obtained from a blast furnace heat balance equation.

However, since the blast furnace is slow to respond, the method which is based only upon the information available at the present time, is disadvantageous in that it is difficult to obtain proper furnace temperature control.

As shown in FIG. 1, the ore, coke, etc., are charged into the blast furnace from the top thereof. The hot blast is blown through tuyeres countercurrently with the charge. Thus, the hot metal is tapped through tapping holes and the gas is discharged from the top of the furnace. The operation data including the charge data, blast data, tap data and top gas data are ordinarily entered into a computer which then indicates to the operator the course he should follow to control furnace operation. As described above, however, the blast furnace operation involves a large time lag in response to the variation in the condition of charging or blast. Accordingly, closed loop control of the operation is ineffective without appropriate prediction of the process.

The present invention accomplishes effective closed loop control by precisely predicting the temperature of the burden or the hot metal.

One characteristic of the present invention resides in employing a process model. The process model of the present invention is based on the following assumptions:

(1) the working volume of the furnace is vertically subdivided into a plurality of horizontal zones,
(2) in each zone, predetermined reactions proceed uniformly, and
(3) said horizontal zones include a zone at the lower side in which carbon solution reaction (R4) and pig iron production reaction (R5) proceed;

$$C+CO_2 \rightarrow 2CO \quad \text{(R4)}$$

$$FeO+CO \rightarrow Fe+CO_2 \quad \text{(R5)}$$

The process model which satisfies the above assumptions includes an IRSID Model, BISRA Model and TS Model. The IRSID Model is disclosed in the article "ON-LINE COMPUTER CONTROL FOR THE BLAST FURNACE" (January-February 1965, JOURNAL OF METALS). The BISRA Model is also well-known to those skilled in the art. The TS Model has been developed by Sumitomo Metal Industries, Ltd. in cooperation with the "Free Institute of Tecnology" in Japan. In this model, the working volume of the furnace is vertically divided into at least three horizontal zones including a preheating zone, reducing zone and carbon burning zone. This model will be described in detail hereinafter.

The other characteristic of the present invention is the discovery that the future reaction rates $\widehat{Rm}$ can be properly predicted from the present time reaction Rm and predetermined step response characteristics, and that the temperature of the solid in the furnace and hot metal or Si Content for future time can also be effectively predicted on the basis of the material and heat balance equations.

In accordance with the present invention, there is provided a method of controlling a blast furnace operation by changing the value of the following manipulating variables: the blast oil rate, blast moisture, blast oxygen rate, blast rate, blast temperature and ore/coke ratio. The method comprises:

(A) assuming a process model on the basis of the following conditions:
  (1) the working volume of the furnace is vertically subdivided into a plurality of horizontal zones,
  (2) in each zone, predetermined reactions proceed uniformly, and
  (3) said horizontal zones include a zone at the lower side in which zone carbon solution reaction (R4) and pig iron production reaction (R5) proceed;

$$C+CO_2 \rightarrow 2CO \quad \text{(R4)}$$

$$FeO+CO \rightarrow Fe+CO_2 \quad \text{(R5)}$$

(B) conducting measurements and analyses to obtain the following process data: the charge data, top gas data, blast data and tap data, (C) predicting the future temperature $\widehat{Ti}$ of the i-th zone by the steps of:
  (1) calculating the reaction rates R4 and R5 from the process data,
  (2) predetermining the step response characteristics of the reaction rates R4 and R5 when changing the calues of the manipulating variables,
  (3) calculating the future reaction rates $\widehat{R4}$ and $\widehat{R5}$ from the present reaction rates R4 and R5 and the step response characteristics,
  (4) calculating the future reaction rates $\widehat{Rm}$ of the reaction (Rm) in the zones from the future reaction rates R4 and R5 and the manipulating variables,
  (5) calculating the future temperature $\widehat{Ti}$ of the i-th zone from the future reaction rates $\widehat{Rm}$, the process data and the manipulating variables, on the basis of the material and heat balance equations applied to the model, (D) changing the value of at least one of the manipulating variables to control the temperature of the i-th zone according to the following equation:

$$U^* = U^0 + \sum_j G_u^j (Ti^* - \hat{Ti}^j$$

where

U*: value of manipulating variable after change
U°: value of manipulating variable at present time
$G_u^j$: coefficient
Ti*: target temperature of i-th zone $\hat{T}i^j$: predicted temperature of i-th zone at future time j, In accordance with an embodiment of the invention, the method employs a process model wherein the working volume in the future is subdivided into five zones and the following reactions proceed therein:

first zone; preheating of the charge.

second zone;

$$3\ Fe_2O_3 + CO \rightarrow 2\ Fe_3O_4 + CO_2 \quad (R1)$$

third zone;

$$C + CO_2 \rightarrow 2\ CO \quad (R2)$$

$$Fe_3O_4 + CO \rightarrow 3\ FeO + CO_2 \quad (R3)$$

$$Fe_3O_4 + H_2 \rightarrow 3\ FeO + H_2O \quad (R9)$$

$$CaCO_3 \rightarrow CaO + CO_2 \quad (R10)$$

fourth zone;

$$FeO + CO \rightarrow Fe + CO_2 \quad (R5)$$

$$C + CO_2 \rightarrow CO \quad (R4)$$

fifth zone;

$$C + \tfrac{1}{2}O_2 \rightarrow CO \quad (R6)$$

$$C + H_2O \rightarrow CO + H_2 \quad (R7)$$

$$CnHm \rightarrow nC + m/2H_2 \quad (R8)$$

According to a future embodiment of the invention, the future pig iron temperature $\hat{T}$ pig is calculated by the following equations;

$$\hat{T}^j_{pig} = \hat{T}Sn^j - \delta T_{pig}^{-1}$$

$$\delta T_{pig}^{-1} = TSn^{-1} - T_{pig}^{-1}$$

where $\hat{T}_{pig}{}^j$; temperature of pig iron tapped at future time j, $\hat{T}Sn^j$; calculated temperature of the solid in the lowest zone at future time j, $T_{pig}{}^{-1}$; actual pig iorn temperature of the latest tap $TSn^{-1}$; calculated temperature of the solid in the lowest zone at the time of the latest tap and the value of at least one of the manipulating variables is changed to control the temperature of pig iron according to the following equation:

$$U^* = U^o + \sum_k G_u{}^j (T^*_{pig} - \hat{T}^j_{pig})$$

wherein

U*; value of manipulating variable after the change

U°; value of manipulating variable at present time $G_u{}^j$; coefficient $T^*_{pig}$; target temperature of pig iron According to a still another embodiment, the future silicon content Si of the pig iron is calculated by the following equations:

$$\hat{Si}^k = \hat{TSn}^k - \delta Si^{-1} \qquad \hat{S}_i{}^j = C_1 \hat{TS}_i{}^j + C_2 - \delta Si^{-1}$$

$$\delta Si^{-1} = TSn^{-1} - Si^{-1} \qquad \delta Si^{-1} = C_1 TSn^{-1} + C_2 - Si^{-1}$$

wherein $\hat{S}_i{}^j$; predicted silicon content of the pig iron tapped at future time j $\hat{T}Sn^j$; predicted temperature of the solid in the lowest zone at future time j $Si^{-1}$; actual silicon content of the pig iron of the latest tap $TSn^{-1}$; calculated temperature of the solid in the lowest zone at the time of the latest tap, and $C_1$, $C_2$; constant The value of at least one of the manipulating variables is changed to control the silicon content of pig iron according to the following equation:

$$U^* = U^o + \sum_j G_u{}^j (Si^* - \hat{S}_i{}^j)$$

wherein

U*; value of the manipulating variable after the change

U°; value of the manipulating variable at present time $G_u{}^j$; coefficient

Si*; target silicon content of pig iron

FIG. 1 schematically explains the blast furnace process and the controlling system;

Figure 9:
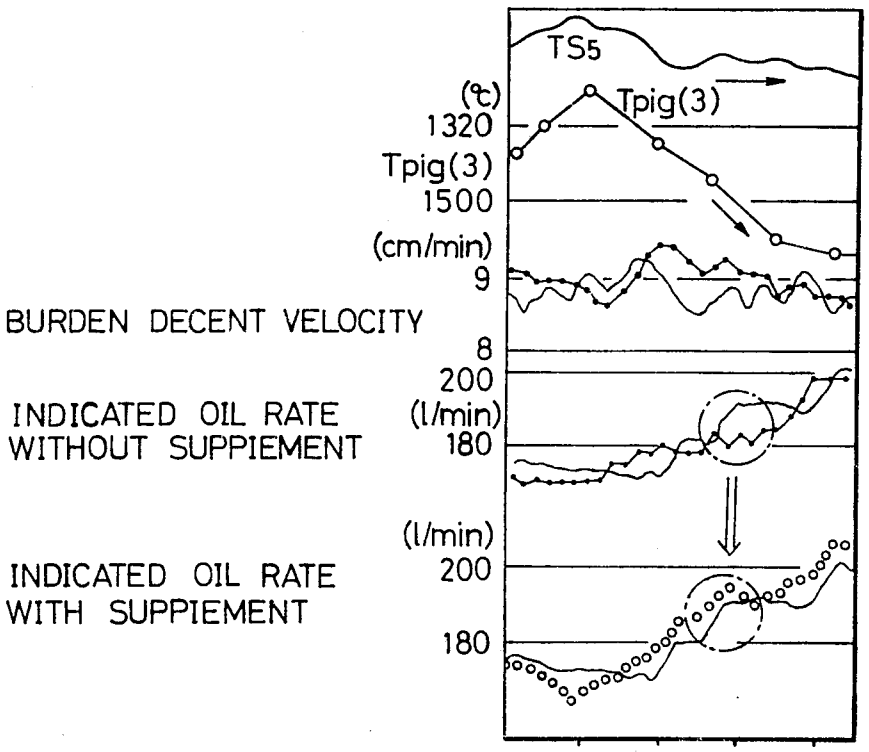
Figure 10:
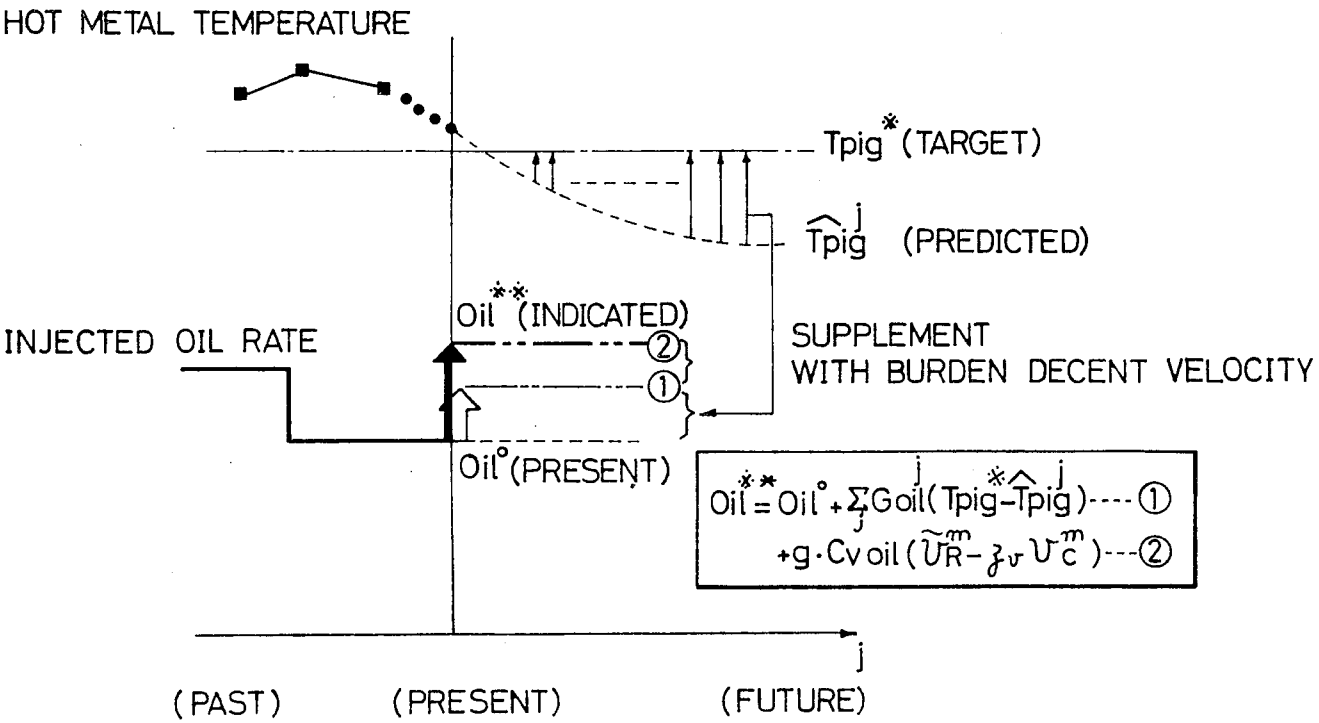

FIG. 9 is a view showing the deviation between the calculated burden descent velocity and the actually measured burden descent velocity as well as the effect of the improvement obtained by correcting the burden descent velocity; and FIG. 10 is a view showing a method of determining the extent of the change in manipulating variables from the predicted hot metal temperature and the burden descent velocity correction.

An embodiment of the present invention will be explained in conjunction with the accompanying drawings. In this embodiment, the TS Model of five horizontal zones is employed.

Figure 2:
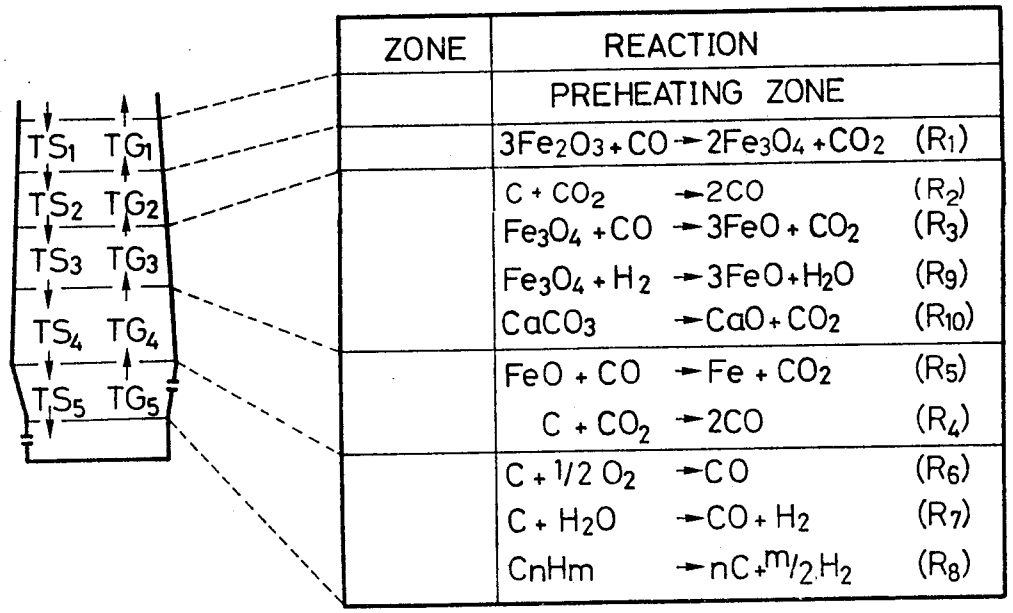
FIG. 2 is a view showing the definition of each zone and reaction in the example model.

(1) TS Model and Calculation of the Present Temperature of the Solid in the furnace (A) TS Model In this model, as shown FIG. 2, the charged materials are simply heated and the reductions do not occur at the upper parts of the furnace shaft (1st zone). In the next zone of the shaft (2nd zone) where the solid temperature is still low, only the reduction reaction $Fe_2O_3 \rightarrow Fe_3O_4$ proceeds. At the lower parts of the shaft (3rd zone), the reduction of $Fe_3O_4 \rightarrow FeO$ occurs. At the lower parts of the furnace (4th zone) where the temperature is higher than 1000° C., both the reduction of FeO→Fe and the carbon solution reaction occur.

In order to construct this model, the other assumptions are summarized as follows.

Figure 3:
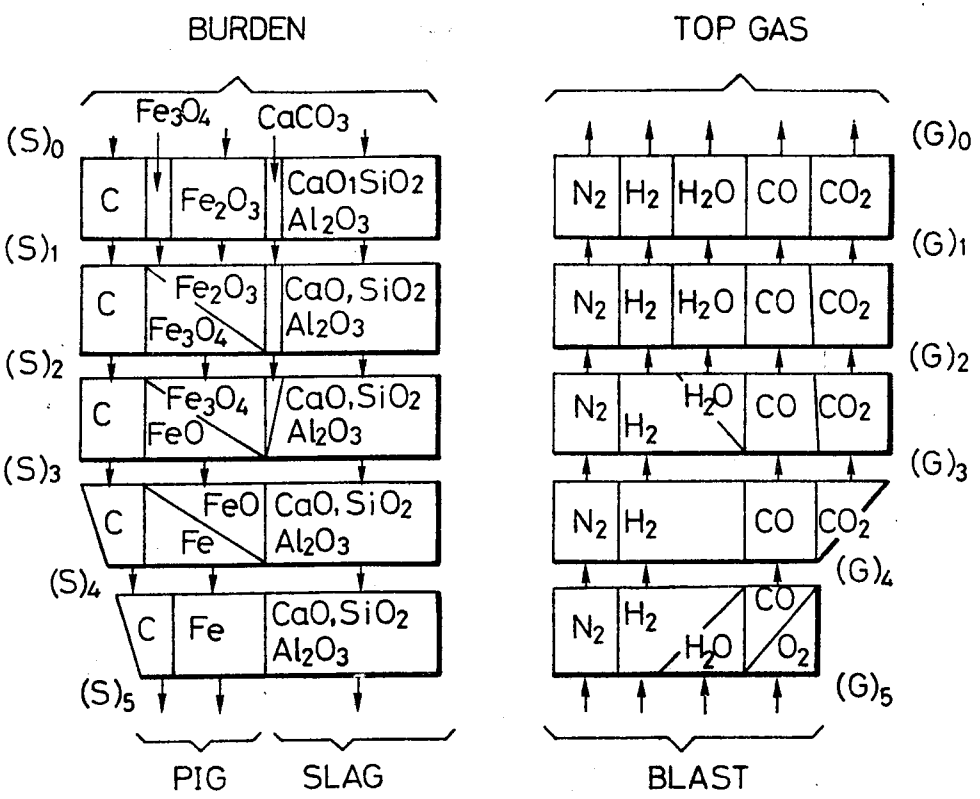
FIG. 3 is a view showing the distribution and transfer of the materials in the model.

(1) The working volume of the furnace is subdivided into five horizontal zones where only the specified materials exist and where only the specified reactions uniformly proceed (refer to FIG. 2 and FIG. 3).

(2) The amount of the material existing in each zone does not vary.

(3) The balances of the following materials, i.e. CO, $CO_2$, $H_2$, $N_2$, $O_2$, $H_2O$, $Fe_2O_3$, $Fe_3O_4$, FeO, Fe, C, $CaCO_3$ and X ($Al_2O_3$+CaO+$SiO_2$), must be satisfied. The materials existing in each zone and being transferred to another zone are shown in FIG. 3.

(4) Each zone is regarded as a packed bed in which chemical reactions occur.

(5) As to the temperature, only the average temperature of solids (TSi) and gases (TGi) of each zone are considered.

(B) Calculation of the Present Temperature of the Solid in the Furnace

Figure 4:
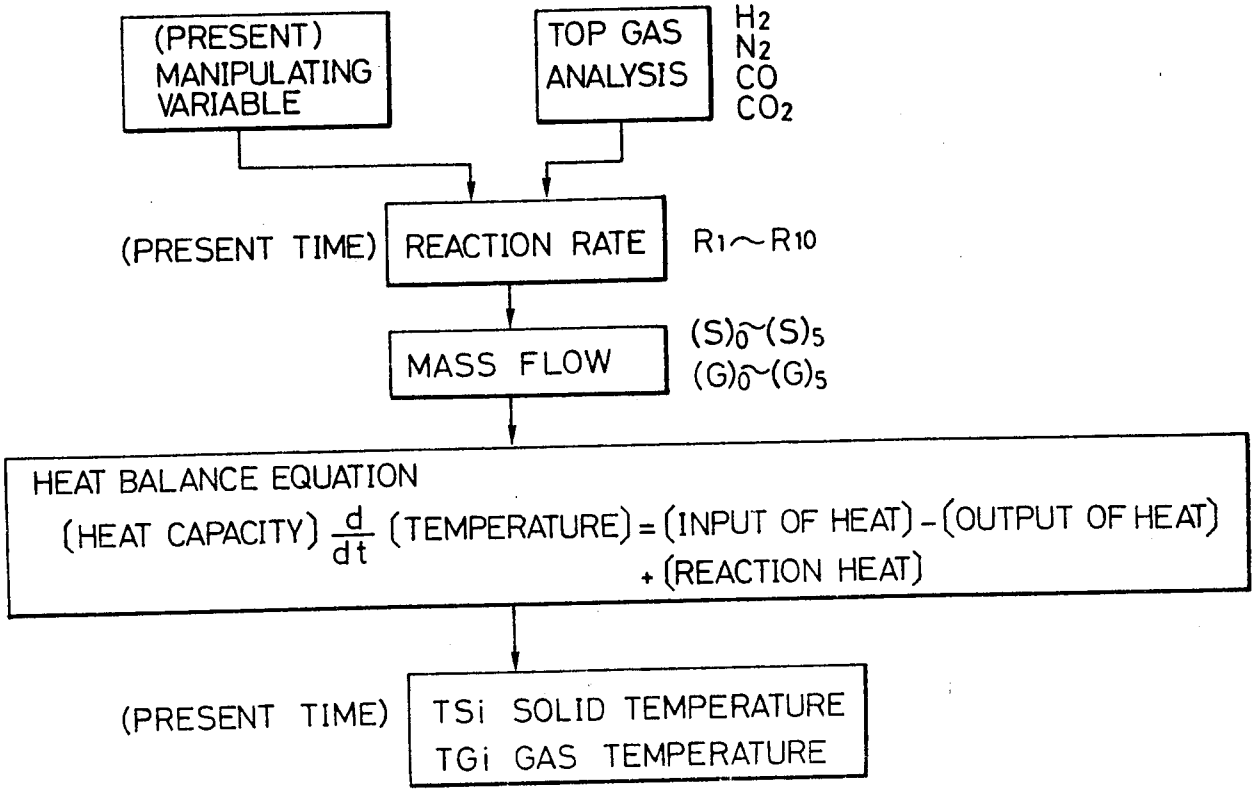
FIG. 4 is a view showing the calculation procedure for deriving the present times TSi and TGi.

On the basis of the above assumptions, the temperature of the burden in each zone can be calculated as shown in FIG. 4.

(1) Calculation of the Reaction Rate Rm CO, $CO_2$ and $H_2$ balance equations from bottom to top of the blast furnace are derived as follows.

$$(CO)_o = -(R_1 + R_3 + R_5) + 2(R_2 + R_4) + R_6 + R_7 \quad (1)$$

$$(CO_2)_o = (R_1 + R_3 + R_5) - (R_2 + R_4) + R_{10} \quad (2)$$

$$(H_2)_o = \frac{P\ oil\ H}{2}(Oil)_5 + R_7 - R_9 \quad (3)$$

From $Fe_2O_3$ balance at the 2nd zone, $Fe_3O_4$ balance at the 3rd zone and $CaCO_3$ balance at the 3rd zone, the following equations are obtained.

$$(Fe_2O_3) = 3R_1 \quad (4)$$

$$(Fe_3O_4)_o = R_3 + R_9 - 2R_1 \quad (5)$$

$$(CaCO_3)_o = R_{10} \quad (6)$$

Furthermore, if it is assumed that the injected $O_2$, $H_2O$ and oil react compeletely and immediately, the following are obtained.

$$2(O_2)_5 = R_6 \quad (7)$$

$$(H_2O)_5 = R_7 \quad (8)$$

$$(oil)_5 = R_8 \quad (9)$$

$$r_2X = R_2/(R_2 + R_4) \quad (10)$$

where, $(S)_o$: Solid material S charged at the top $(G)_o$: gaseous material G leaving from the top $(G)_5$: gaseous material G blown into the furnace P oil H: ration of hydrogen content in heavy oil $r_2X$: constant.

The charging of the materials is treated as a continuous process with the following charging rate.

$(S)_o$=(the weight-ratio of solid material S to total Fe in the charged materials)×$R_5$ (11)

By solving the simultaneous equations(1)–(10), $R_1$–$R_{10}$ are obtained as shown in Table 1.

TABLE 1

| | Reaction Rate (Rj) |
|---|---|
| $R_1$ | $\frac{1}{3} R_{Fe_2O_3} R5$ |
| $R_2$ | $r_2x[(CO_2)_0 + (CO)_0 - 2(O_2)_5 - (H_2O)_5 - R_{CaCO_3}R5]$ |
| $R_3$ | $\frac{1}{3} R_5 - R_9$ |
| $R_4$ | $(1 - r_2x)[(CO_2)_0 + (CO_0 - 2(O_2)_5 - (H_2O)_5 - R_{CaCO_3}R_5]$ |
| $R_5$ | $\frac{2(CO_2)_0 + (CO)_0 - 2(O_2)_5 + \frac{P\ oil\ H}{2}(Oil)_5 - (H_2)_0}{2R_{CaCO_3} + 3R_{Fe_2O_3} + 4R_{Fe_3O_4}}$ |
| $R_6$ | $2(O_2)_5$ |
| $R_7$ | $(H_2O)_5$ |
| $R_8$ | $(Oil)_5$ |
| $R_9$ | $(H_2O)_5 + \frac{P\ oil\ H}{2}(oil)_5 - (H_2)_5, \eta H_2$ |
| $R_{10}$ | $R_{CaCO_3}R_5$ |

$(S)_0$: solid material S charged at the top of the blast furnace $(G)_0$: gaseous material G leaving from the top of the blast furnace $(G)_5$: gaseous material G blown into the furnace Rs: weight-ratio of solid material S to total Fe in charged materials $P_{oilH}$: ratio of H content in heavy oil

S:

$Fe_2O_3$ $Fe_3O_4$ $CaCO_3$ $Al_2O_3$

CaO $SiO_2$

C $$\eta H_2 : \frac{(H_2)_5 - (H_2)_0}{(H_2)_5}$$

$(G)_0$ can be expressed in terms of the top gas data as follows:

$(CO)_0 = P_{CO} \cdot VBO$ $(CO_2)_0 = P_{CO2} \cdot VBO$ $(H_2)_0 = P_{H2} \cdot VBO$ wherein, $P_{CO}$: CO ratio of the top gas $P_{CO2}$: $CO_2$ ratio of the top gas $P_{H2}$: $H_2$ ratio of the top gas VBO: flow ratio of the top gas VBO may be actually measured or may be calculated from the following $N_2$ balance equation:

$VBO = (0.79/PN_2) \times VBi$

VBi: Blast rate $PN_2$: $N_2$ ratio of the top gas (2) The amount of material transferred to the next zone.

The amount of material transferred to the next zone is generally calculated as follows.

$$(S)_i = (S)_{i-1} + \sum_{m=1}^{10} S_{im} \cdot R_m \quad (12)$$

$$(G)_{i+1} = (G)_i + \sum_{m=1}^{10} G_{im} \cdot Rm. \quad (13)$$

where, $(S)_{i-1}$[Kmol/min]: solid material S coming into i-th zone $(G)_i$[Kmol/min]: gaseous material G coming into i-th zone $S_{im}$, $G_{im}$[−]: amount of material S, G generated by reaction $R_m$ at i-th zone, respectively For example, the transfer of $Fe_2O_3$ in each zone is expressed as follows:

$(Fe_2O_3)_0 = R_{Fe2O3} \cdot R_5$ $(Fe_2O_3)_1 = (Fe_2O_3)_0 + O = (Fe_2O_3)_O$ $(Fe_2O_3)_2 = (Fe_2O_3)_1 - 2 \cdot R_1 = 0$ $(Fe_2O_3)_5 = (Fe_2O_3)_4 = (Fe_2O_3)_3 = (Fe_2O_3)_2 = 0$ (3) Heat balance The increase in thermal energy in each zone is calculated from thermal energy carried in ((1)) and out ((2)), heat of chemical reactions ((3)), heat flow between gas and solid ((4)), and heat loss through the wall ((5)).

a. Heat balance equations for solids and gas

The equation for solids in the i-th zone is as follows.

$$\left(\sum^{S_i} [S]_i CS_i\right) \frac{dTS_i}{dt} = \underbrace{\sum^{S_{i-1}} (S)_{i-1} CS_{i-1} TS_{i-1}}_{(1)} - \underbrace{\sum^{S_i} (S)_i \widetilde{C}S_i TS_i}_{(2)} + \underbrace{\sum_{m=1}^{10} RX_{im} R_m H_m (1 - P_m)}_{(3)} + \underbrace{Z_i(TS_i - TG_i)}_{(4)} - \underbrace{HW_i A_i (TS_i - T_a)}_{(5)} \quad (i = 1 - 5) \tag{14}$$

where, $S_i$: summing up for solid components in the i-th zone d/dt[1/min]: derivatives with respect to time $TS_i$[°C.]: solid temperature in the i-th zone $TG_i$[°C.]: gas temperature in the i-th zone $T_a$[°C.]: temperature of atmosphere $CS_i$[Kcal/Kmol°C.]: specific heat of solid at $TS_i$ $CS_i$[Kcal/Kmol°C.]: average specific heat of solid from 0° C. to $TS_i$ $[S]_i$[Kmol]: staying amount of solid material S in the i-th zone $RX_{im}$[—]: coefficient of reaction $R_m$ in the i-th zone $RX_{im}$[—]: coefficient of reaction $R_m$ in the i-th zone If the reaction $R_j$ occurs in the i-th zone, $RX_{im}=1$, If not, $RX_{im}=0$ $P_m$[—]: ration of heat applied to gas by reaction $R_m$ $\Delta H_m$[Kcal/Kmol]: heat generated by reaction $R_m$ $Z_i$[Kcal/°C.]: heat transfer coefficient between gas and solid $HW_i$[Kcal/m²°C.min.]: heat transfer coefficient at the wall $A_i$[m²]: surface area in the i-th zone of the furnace The equation for gas in the i-th zone is as follows:

$$\left(\sum^{Gi} [Gi] \cdot C_{Gi}\right) \frac{dTGi}{dt} = \sum^{Gi+1} (Gi + 1) \cdot \widetilde{C}i + 1\, TGi + 1 - \sum^{Gi} (Gi);\ \widetilde{C}i\, TGi + \sum_{m=1}^{10} RXim \cdot Rm \cdot \Delta Hm(1 - P_m) + Zi(TGi - TSi) - HwiAi(TGi - Ta)\ (i = 1 - 5) \tag{16}$$

Σ; summing up for gas components in the i-th zone $C_{Gi}$[Kcal/Kmol°C.]; specific heat of gas at TGi $\widetilde{C}_{Gi}$[Kcal/Kmol°C.]; average specific heat of gas from 0° C. to TGi

[G]i[Kmol]; amounting of gaseous material G remained in the i-th zone

The heat balance equations, i.e. 1st order simultaneous differential equations (14) and (15) concerning $TS_i$ and $TG_i$ are solved by taking $TS_i$ and $TG_i$ at the latest time as the initial values. Then the $TS_i$ and $TG_i$ at this time are calculated.

(II) Calculation of the Future Temperature of the Solid in the Furnace

The calculation of the future temperature of the solid in the furnace can be made in the same manner as that for the present temperature described above, except for calculating the future reaction rate from a prediction formula in lieu of the top gas data. The method of calculation will be explained with reference to FIG. 5.

(A) Prediction of the Future Reaction Rate (1) As may be readily understood from Table 1 above, the reaction rates R6 and R7 and R8 can be obtained directly from the blast data at the tuylres. Thus, the future reaction rates $\hat{R}6$, $\hat{R}7$ and $\hat{R}8$ can be obtained from the variation in the blast condition. The reaction rates R1, R2, R3 and R10 are calculated from the rates R4, R5 and R9. The reaction rate R9 is function of the hydrogen utilization rate $\eta H_2$. The rate $\eta H_2$ is stable in the ordinary blast furnace process. Thus, the future reaction rate R9 can be properly obtained by extrapolating the rate $\eta H_2$ at present as follows:

$$\hat{R}9^j = \eta^{\circ} H_2 \cdot (H_2)_5^j$$

wherein, j; future time j

°; present time $(H_2)_5^j$; $H_2$ in the blast and oil at future time j

Accordingly, the future reaction rate $\hat{R}m$ other than $\hat{R}4$ and $\hat{R}5$ can be properly obtained from the manipulating data.

(2) Reactions (R4) and (R5) have a significant influence on the temperature of the furnace and vary in response to the change in the manipulating conditions of the blast and charge and in response to the change in the gas flow in the shaft. Although it is difficult to precisely predict the change in gas flow, it is possible to properly predict the future rates $\hat{R}4$ and $\hat{R}5$ which respond to the change in the manipulating conditions.

The method of predicting $\hat{R}_4$ and $\hat{R}_5$ will be explained.

In the first place, the response of the reaction rates R4 and R5 to manipulating variables Un (n: oil, blast rate, enriched oxygen, ore/coke ratio, blast temperature, moisture and top pressure) is examined by blast furnace data analysis, step response experiments and so forth to determine response coefficients $K_n^1$ and $K_n^{1'}$ in the reaction rate equations, as follows.

Figure 6:
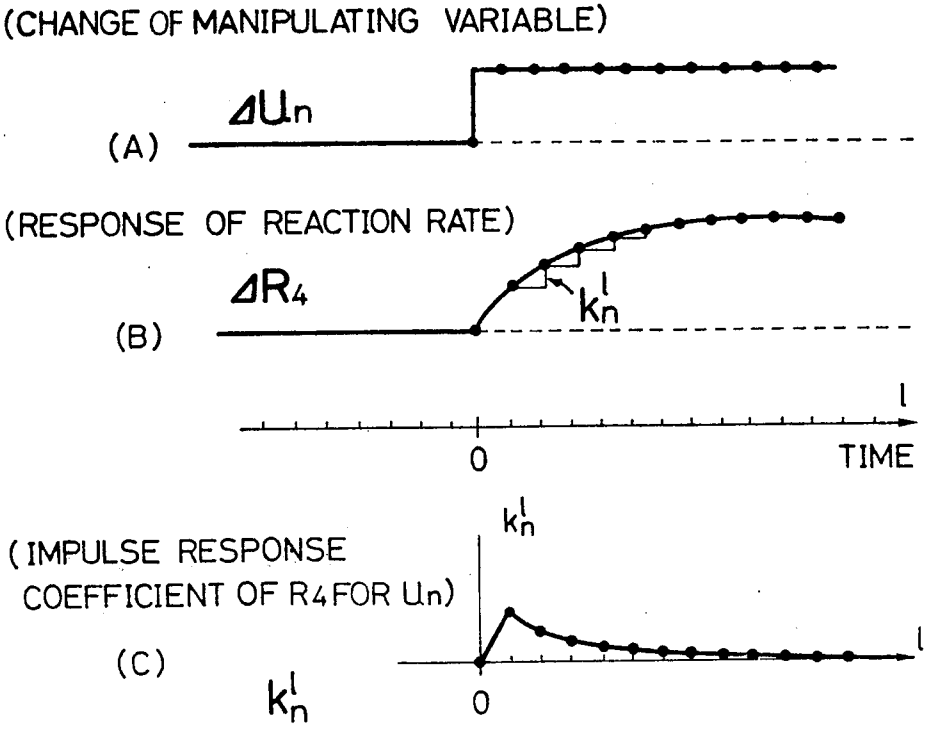
FIG. 6 is a view showing a method of obtaining the reaction rate response coefficient from the step response characteristics.

By changing some manipulating variable (for instance injected oil rate) by ΔUn at an instant 1 (as shown in (A) in FIG. 6) the rate of change of $R_4$ is obtained (as shown in (B) in FIG. 6). By using this rate of change, $K_n^1$ until an instant L at which $\Delta R_4$ converges to be within a predetermined tolerance range is obtained by using equation (16), (17) (as shown in FIG. 6).

$$K_n^1 = (R_4^1 - R_4^{1-1})/\Delta Un \tag{16}$$

and $$K'^{l}_{n} = (R_5^{l} - R_5^{1-1})/\Delta Un \tag{17}$$

Consequently, $R_4$ and $R_5$ at an instant j corresponding to the manipulating variable ΔUn are given as $$R_4^j = \sum_n \left( \sum_{1=j-L}^{j} k_n^{j-1} \cdot U_n^1 \right) \tag{16'}$$

and

-continued $$R_5^j = \sum_n \left( \sum_{l=j-L}^{j} k_n'^{j-1} \cdot U_n^l \right) \quad (17)'$$

The, since the present reaction rate can be calculated from the top gas composition as mentioned earlier, the reaction rate equations are corrected by using $R_4^o$, $R_5^o$ and $k_n^l$, $k'^l_n$ as follows:

$$R_4^j = R_4^o + \sum_n \left( \sum_{l=j-L}^{j} k_n^{j-1} \cdot U_n^l - \sum_{l=-L}^{O} k_n^{-1} \cdot U_n^l \right) \quad (18)$$

and $$R_5^j = R_5^o + \sum_n \left( \sum_{l=j-L}^{j} k_n'^{j-1} \cdot U_n - \sum_{l=-L}^{O} k_n^{-1} \cdot U_n^l \right) \quad (19)$$

where, $R_4^j$, $R_5^j$: predicted $R_4$, $R_5$ at future time j, $R_4^o$, $R_5^o$: $R_4$, $R_5$ calculated at present $U_n^l$: value of manipulating variable Un at time l (the present value of manipulating variable being held at the future instant if there were no dicision about manipulation), and $Kn'^l K'n^l$: impulse response coefficient of $R_4$, $R_5$ at time l with respect to $U_n$.

Table 2 shows the future reaction rates $\hat{R}m$ which are obtained as mentioned above.

TABLE 2

| | Reaction Rate at Future time j |
|---|---|
| $\hat{R}_1^j$ | $\frac{1}{3}R_{Fe2O3} \cdot \hat{R}_5^j$ |
| $\hat{R}_2^j$ | $\frac{r_{2x}}{1 - r_{2x}} \cdot \hat{R}_4^j$ |
| $\hat{R}_3^j$ | $\frac{1}{3}\hat{R}_5^j - \hat{R}_9^j$ |
| $\hat{R}_4^j$ | $R_4^O + \sum_n \left( \sum_{l=j-L}^{j} k_n^{j-1} \cdot U_n^l - \sum_{l=-L}^{O} k_n^{-1} \cdot U_n^l \right)$ |
| $\hat{R}_5^j$ | $R_5O + \sum_n \left( \sum_{l=j-L}^{j} k_n'^{j-1} \cdot U_n^l - \sum_{l=L}^{O} k_n'^{-1} \cdot U_n^l \right)$ |
| $\hat{R}_6^j$ | $2(O)_5^j$ |
| $\hat{R}_7^j$ | $(H_2O)_5^j$ |
| $\hat{R}_8^j$ | $(Oil)_5^j$ |
| $\hat{R}_9^j$ | $\hat{\eta}H_2\,(H_2)_5^j$ |
| $\hat{R}_{10}^j$ | $R_{CaCO3} \cdot \hat{R}_5^j$ |

$\hat{\eta}H_2$ is assumed to be equal to $\eta H_2^o$ (at present).

(B) Prediction of the Future Temperature of the Solid in the Furnace

Figure 5:
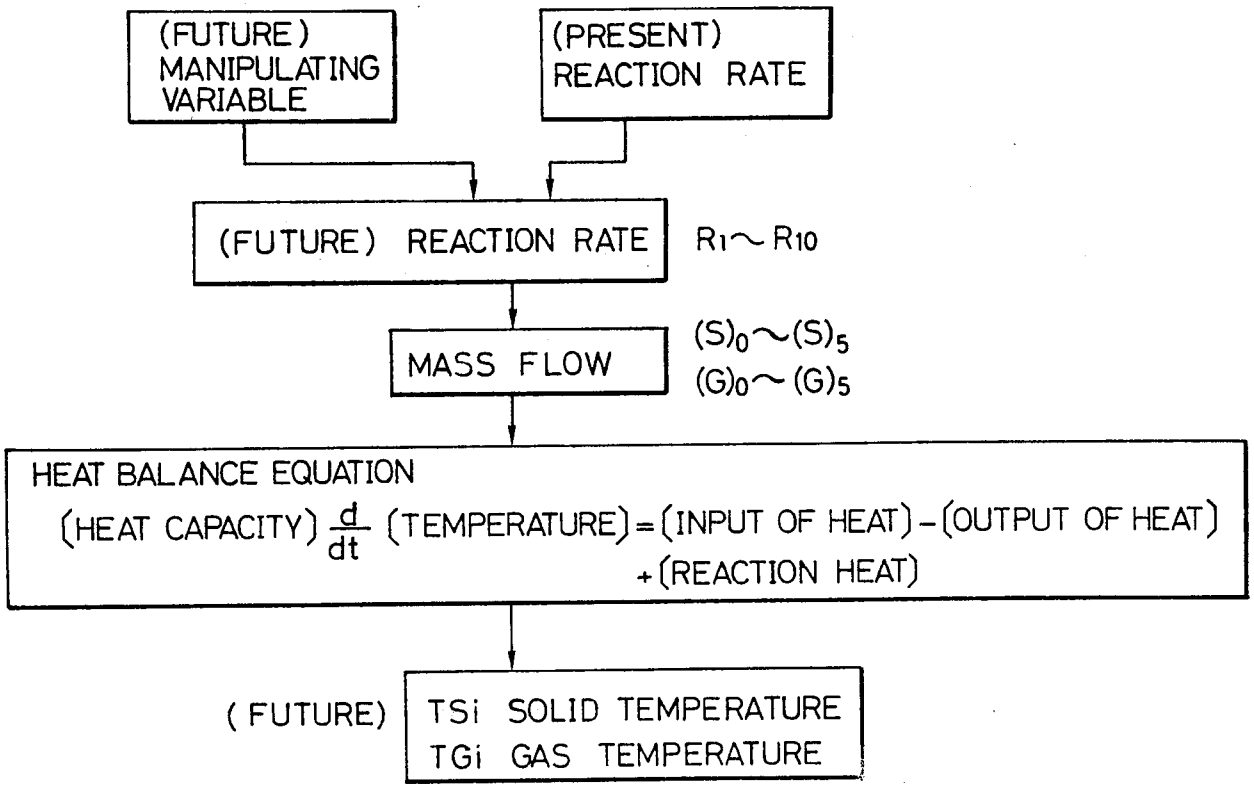
FIG. 5 is a view showing the calculation procedure for deriving the future times $\hat{T}$Si and $\hat{T}$Gi.

As shown schematically in FIG. 5, the calculation of the future temperature can be made in the same manner as that of the present temperature except for using the future reaction rates. The calculation of the future temperature may be made both on the assumption that there will be no change in the manipulating variables or on the assumption that there is a certain change in them. The calculation based on the former assumption can be utilized to warn of an abnormal heating up of the burden. The one based on the latter assumption may be utilized to simulate the blast furnace operation to determine the appropriate manipulating condition.

We will describe a method of automatically controlling the hot metal temperature on the basis of the former assumption.

(III) Determination of Manipulating Variables and Control of Hot Metal Temperature and Si Content on the Basis of Predicted Hot Metal Temperature and Si Content It has been confirmed that there are good one-to-one correspondence characteristics of the calculated furnace lower portion solid temperature $TS_5$ with respect to the actual hot metal temperature and Si content. These characteristics permit precise prediction of the temperature and Si content of the hot metal and are useful as a guide to the furnace temperature control by momentarily indicating the present $TS_5$ and predicted $\hat{T}S_5$ to the operator. Upon developing the aforementioned predicting method, the inventors have conducted research and investigations regarding the method of changing the manipulating variables for furnace temperature control by using this predicting method. On the basis of these investigations the inventors have invented a method which will be described hereinafter.

While the calculated solid temperature $TS_5$ corresponds well to the actual hot metal temperature $T_{pig}$ or to the actual hot metal Si content, in the course of an extended period of time a difference in level between $TS_5$ and $T_{pig}$ or Si content is likely to change due to a drift from the calculated temperature or a change in heat loss in the furnace.

Accordingly, for the control of the hot metal temperature or Si content it is necessary to suitably correct the level difference. In case of controlling, for instance, the hot metal temperature as an index, the predicted hot metal temperature is corrected by using the measured hot metal temperature $T_{pig}$ and the difference $\delta T_{pig}$ therefrom with respect to the calculated present bottom tenperature $TS_5$ at the instant of the measurement (see FIG. 7) as expressed by equations $$\hat{T}_{pig}^j = \hat{T}S_5^j - \delta T_{pig}^{-1} \quad (20)$$

and $$\delta T_{pig}^{-l} = TS_5^{-l} - T_{pig}^{-l} \quad (21)$$

where $\hat{T}_{pig}^j$: predicted hot metal temperature at future instant j, $\hat{T}S_5^j$: predicted bottom temperature $TS_5$ at future instant j, $T_{pig}^{-1}$: actual hot metal temperature of the latest tap, and $TS_5^{-1}$: calculated present bottom temperature $TS_5$ at the time of the latest tap.

As the $\delta T_{pig}^{-l}$ it is possible to use the average value for several taps as well to remove the influence of measurement error.

The $T_{pig}^j$ obtained in this way is the predicted value of the hot metal temperature at the future instant j when the present manipulating variable values are left unchanged.

Now, a method of determining manipulating variables required for the control of the hot metal temperature will be discussed.

Since the afore-mentioned $\hat{T}_{pig}^j$ is the predicted value of the hot metal temperature at the future instant j when the present manipulating variable value are left unchanged, the hot metal temperature is controlled by instantaneously changing the manipulating variable according to the difference between the target temperature $T_{pig}^*$ and the predicted hot metal temperature $T_{pig}^j$, as given by equation $$U^* = U^o + \sum_j G_u^j \cdot (\hat{T}^*_{pig} - T^j_{pig}) \quad (22)$$

where $U^*$: value of manipulating variable after change, $U^o$: present value of manipulating variable, $G_u^j$: constant (predetermined depending upon the manipulating variable)

$T_{pig}^*$: target hot metal temperature, and $\hat{T}_{pig}^j$: predicted hot metal temperature at future instant j.

The manipulating variable to be changed may be selected from the blast temperature, moisture, oil, coke ratio, etc. as one conforming to the operational plan.

The value of each manipulating variable is calculated by using a constant, which is determined from the step response characteristics of the hot metal temperature with respect to each manipulating variable U, as $G_u^j$ in equation (22).

Now, the case of using the hot metal Si content as the index for the control will be discussed. As in the case of the hot metal temperature, the future hot metal Si content can be predicted as $$\hat{S}i^j = C_1 \cdot \hat{T}S_5^j + C_2 - \delta_{si}^{-l} \quad (20)'$$

$$\delta_{si}^{-l} = C_1 \cdot TS_5^{-l} + C_2 - Si^{-l} \quad (21)'$$

and $\hat{S}_i^j$: predicted hot metal Si content at future instant j, $\hat{T}S_5^j$: predicted furnace lower portion temperature $TS_5$ at future instant j, $Si^{-l}$: actual hot metal Si content for the latest tap, $TS_5^{-l}$: calculated present bottom temperature $TS_5$ at the time of the latest tap.

$C_1$, $C_2$; constant

As the $\delta Si^{-l}$ it is possible to use the average value for several taps as well to remove the influence of the measurement error. The $\hat{S}i^j$ obtained in this way is the Si content of the hot metal at the future instant j when the present manipulating variable value are held unchanged.

The $\hat{S}_i^j$ which is obtained in this way and representing the hot metal Si content at the future instant j is used to determine the value of change of the manipulating variable by using an equation $$U^* = U^o + \sum_j G_u^j (Si^* - \hat{S}_i^j) \quad (22)'$$

where $G_u$: constant (depending upon the selection of the manipulating variable), and $Si^*$: target hot metal Si content.

Since it has been confirmed that the aforementioned blast furnace process model corresponds well with the actual blast furnace phenomena, proper manipulating variable values required for the control of the temperature and Si content of the hot metal are calculated by the above method.

Figure 7:
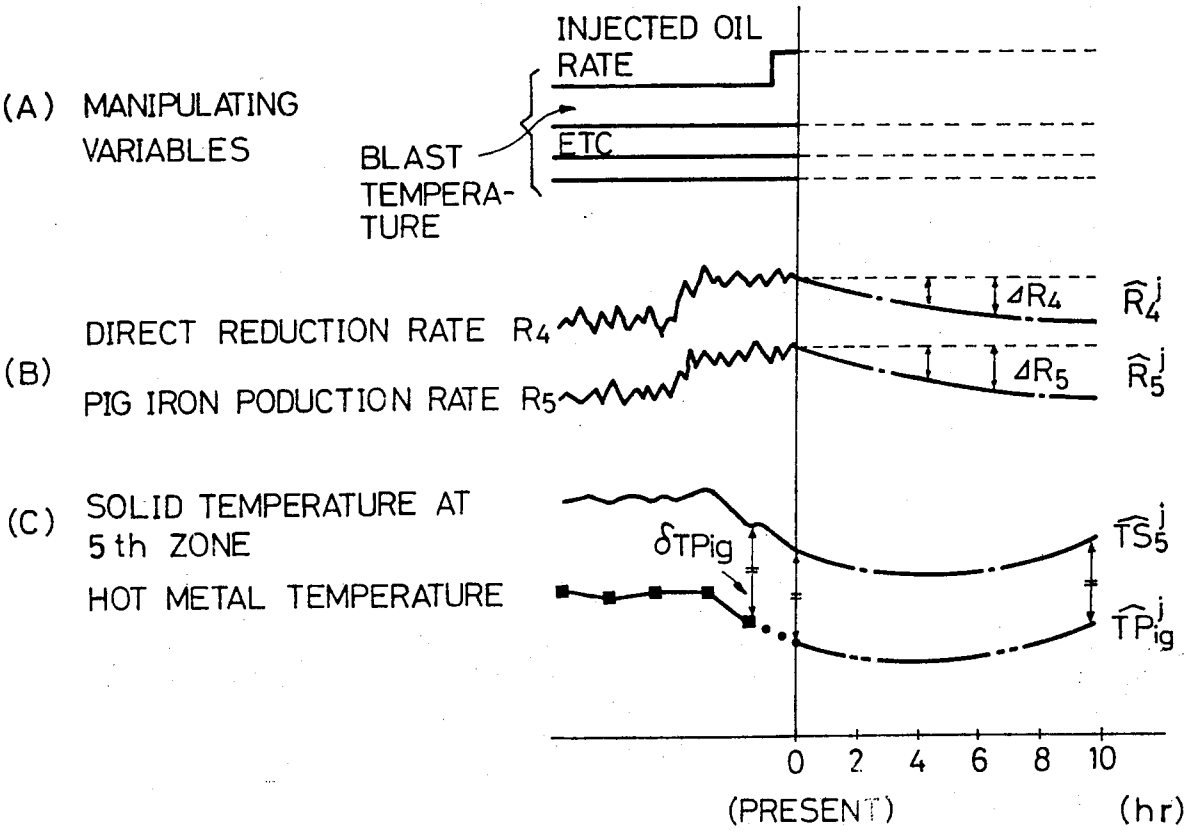
FIG. 7 is a view showing a method of predicting the future time hot metal temperature from the predicted future time $\hat{T}S_5$ and the actually measured hot metal temperature.
Figure 8:
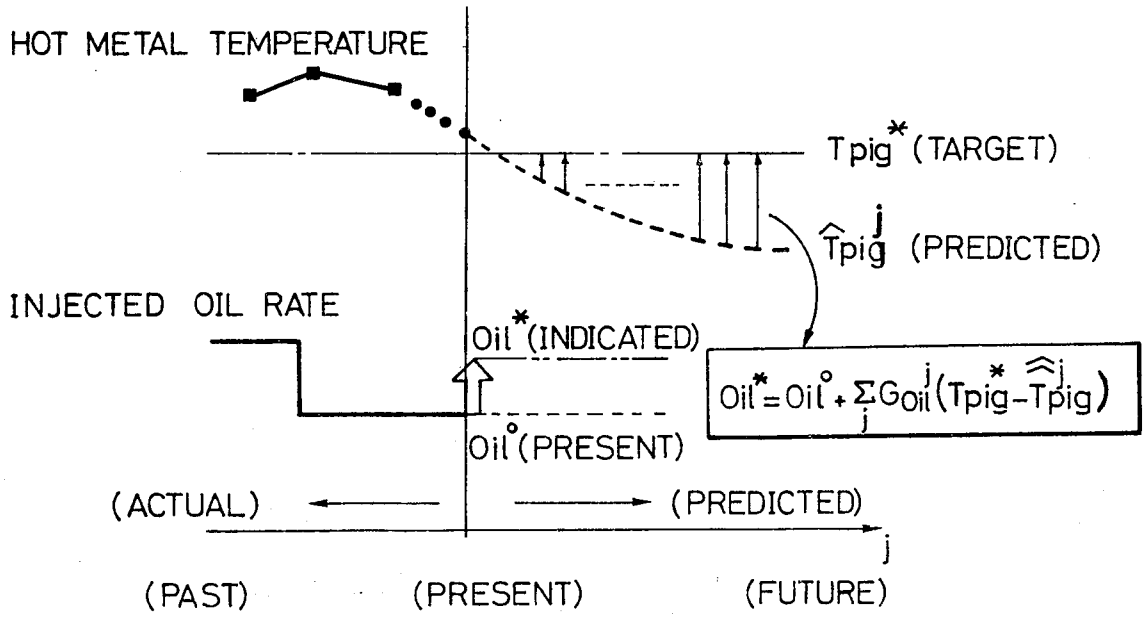
FIG. 8 is a view showing a method of determining the extent of the change in manipulating variables from the predicted hot metal temperature.

FIGS. 7 and 8 show by means of graphs the control of hot metal temperature by selecting oil as the manipulating variable.

A method of determining, in case of changing the injected oil rate, the extent of change in the injected oil rate further for controlling the future hot metal temperature to the target value, as shown in (A) in FIG. 6, will now be discussed. Changes in $R_4$ and $R_5$ are calculated by substituting previously obtained values $k_n^1$ and $k'_n{}^1$ into the respective equations (18) and (19) ((B) in FIG. 7), future values of the bottom solid temperature and hot metal temperature are predicted from the calculated values ((C) in FIG. 7), and the change in the present injected oil rate is determined by using equation (22) such that the future hot metal temperature will be equal to the target value (FIG. 8). The other manipulating variables are similarly determined. Thus, the blast furnace can be automatically controlled by using the manipulating variable values that are calculated in the manner described above.

(IV) Control of Temperature and Si Content of Hot Metal According to Manipulating Variable Compensated for Burden Descent Velocity We have found that the burden descent velocity has a great influence upon the hot metal temperature and that the calculated descent velocity $V_c$ calculated from the model and the actual descent velocity $V_R$ detected by such as sounding rods or actual charge usually coincide with each other with high precision. However, if they do not coincide with each other, correction of the manipulating condition should be made on the basis of the difference between the calculated calue and the actual value of the descent velocity to permit precise control. The method of correction will now be discussed.

The calculated burden descent velocity $V_c$ based on the model is obtained from the coke consumption rate $(coke)_c$ and pig iron production rate $(pig)_c$ by using equations $$V_c = \frac{1}{s} \frac{(coke)c}{\rho\ coke} + \frac{OR \cdot (pig)c}{\rho\ ore} \quad (23)$$

and $$\tilde{V}_c^m = \frac{\text{Calculated value of } V_c \text{ for } t}{\Delta t} \quad (24)$$

(with $\Delta t$ being the period required for the past m charging cycles)

where $\tilde{V}_c$[m/min]: average calculated burden descent velocity for a period corresponding to past m charging cycles in the model, (coke)c[kg/min]: coke consumption rate in the model, (pig)c[kg/min]: hot metal production rate in the model, OR[—]: burden ratio $\rho$coke[kg/m$^2$]: coke bulk desity, $\rho$ore[kg/m$^2$]: burden bulk density, and S[m$^2$]: sectional area of furnace.

The (coke)c and (pig)c are calculated by using furnace reaction rates $R_i$ in equations $$(coke)\ c = \frac{12}{Ccoke} [R_6 + R_7 - R_8 + R_4 + \frac{pig\ c}{12} (pig)c] \quad (25)$$

$$(pig)\ c = \frac{56}{pig\ Fe} \cdot R_5 \quad (26)$$

where

C coke [—]: C content in the coke, pig c [—]: C content in the pig, and pig Fe [—]: Fe content in the pig.

The actual burden descent velocity is determined by a sounding rod or actual charge as well known in the art. The average actual burden descent velocity when the descent of the surface of the charge is being measured by using N sounding rods for each charge is calculated in a manner as represented by an equation (27) below.

Detection of average actual burden descent rate by sounding rods $$\widetilde{V}_R{}^m(\text{rod}) = \frac{\Delta l_1 + \cdots + \Delta lm}{\Delta t_1 + \cdots + \Delta tm} \quad (27)$$

$$\Delta \widetilde{li} = \frac{\sum_{j=1}^{N} \Delta l_i^j}{N}. \quad (28)$$

where $\widetilde{V}_R{}^m$(rod) [m/S]: average actual burden descent velocity for past m charges by sounding rods, $\Delta t_i$[S]: period required for detection by reference sounding rod from charging till lifting of the i-th charge, $\Delta l_i^j$[m]: distance of descent of the No. j sounding rod for a period $t_i$ of the i-th charge, $\Delta \widetilde{l}_i$[m]: average distance of descent of N sounding rods for a period $t_i$ for the i-th charge.

Average actual burden descent velocity determined from charge $$\widetilde{V}_R{}^m(\text{charge}) = \frac{\Delta l_1{}^* + \cdots + l_M{}^*}{\Delta t_1{}^* + \cdots + tm} \quad (29)$$

$$\Delta \widetilde{li}^* = \frac{1}{S}\left[\frac{(\text{coke})i^*}{\text{coke}} + \frac{(\text{ore})i^*}{\text{ore}} + (SLi - SLI - 1)\right] \quad (30)$$

where $\widetilde{V}_R{}^m$(charge) [m.min]: average actual burden descent velocity for past m charges, $\Delta l_i{}^*$[m]: average distance of descent for period $t_i$ of the i-th charge as determined from the charge, (coke)i*[kg]: quantity of coke charged at the i-th charge, (ore)i*[kg]: quantity of burden charged at the i-th charge.

Regarding the average actual burden descent rate as determined by equations (27) and (29), it has been confirmed that $V_R{}^m$(rod) and $V_R{}^m$(charge) practically coincide with each other for a short period so long as a large number of sounding rods are used for the measurement (usually 2 to 4 sounding rods being provided in symmetrical positions with respect to the core).

FIG. 9 shows an example in which the calculated burden descent velocity $V_c{}^m$ and actual burden descent celocity $V_R{}^m$(charge) do not coincide with each other. In such a case, the character of correspondence between the calculated temperature $TS_5$ with the model and actual hot metal temperature is deteriorated so that the manipulating variables calculated by equation (22) are no longer adequate. More particularly, it has been confirmed that so long as the difference ($V_R{}^m - V_c{}^m$) is positive the actual burden descent velocity is higher. On the other hand, the actual hot metal temperature is lower than the model calculation temperature in proportion to the difference so that the operation of increasing the hot metal temperature inproportion ot the difference is found to be necessary.

It will be understood from the foregoing that according to the invention calculated and actual burden descent velocities are instanteously obtained from the equation (24) and equations (27) and (29) as shown by equation (26), the calculated velocity is corrected by multiplying it with a coefficient zv which compensates for the usual error in the calculated rate with respect to the actual rate, the difference between both burden descent velocities for a short period of time are detected, and this difference is multiplied with a coefficient $C_{vu}$ of conversion to manupulating variable. Thus, it is possible to effect more adequate hot metal temperature control by correcting the manipulating variable calculated in equation (22) and making momentary control according to this manipulating variable.

Determination of manipulating variable required for hot metal temperature control with compensation for burden descent velocity $$U^{**} = U^\circ + \Sigma Gu^j \cdot (T_{pig}{}^* - \hat{T}_{pig}{}^j) + g \cdot C_{vu}(\widetilde{V}_R{}^m - zv \cdot \widetilde{V}_c{}^m) \quad (31)$$

where

U°: present manipulating variable,

U**: changed manipulating variable compensated for burden descent, $C_{vu}$: coefficient for converting the burden descent velocity difference, g: burden descent velocity correction gain (a positive number less than unity).

$\widetilde{V}_R{}^m$: average actual burden descent velocity for past m charges, $\widetilde{V}_c{}^m$: average calculated burden descent velocity for past m charges, and zv: coefficient for correcting usual difference between $V_c{}^m$ and $V_R{}^m$.

Others: Refer to equation (27).

FIGS. 7 and 10 show schematic views of an example of the hot metal temperature control with injected oil rate selected as the manipulating variable.

As shown in (A) in FIG. 7, when the injected oil rate is changed, the amount of change in the injected oil rate is also determined to control the future hot metal temperature to the target value. This is made by calculating the amounts of change in $R_4$ and $R_5$ from previously obtained $k_n{}^l$ and $k'_n{}^l$ by using equations (18) and (19) ((B) in FIG. 7), predicting future values of the bottom solid temperature and hot metal temperature from the calculated values ((C) in FIG. 7) and determining the amount of change in the present injected oil rate such that the future hot metal temperature is equal to the goal value according to equation (31) by making burden descent velocity correction as shown in FIG. 10.

In the case of the hot metal Si content control the same operation as mentioned above applies, and the manipulating variable is determined by equation (31)'.

Determination of manipulating variable required for hot metal Si content control by burden descent velocity correction $$U^{**} = U^\circ + \Sigma Gu^j(Si^* - \hat{S}i^j) + g' \cdot C'vu(\widetilde{V}_R{}^m - zv \cdot \widetilde{V}_c{}^m) \quad (31)'$$

(Explanation of symbols is omitted since the symbols are identical to those in equation (31).)

Figure 1:
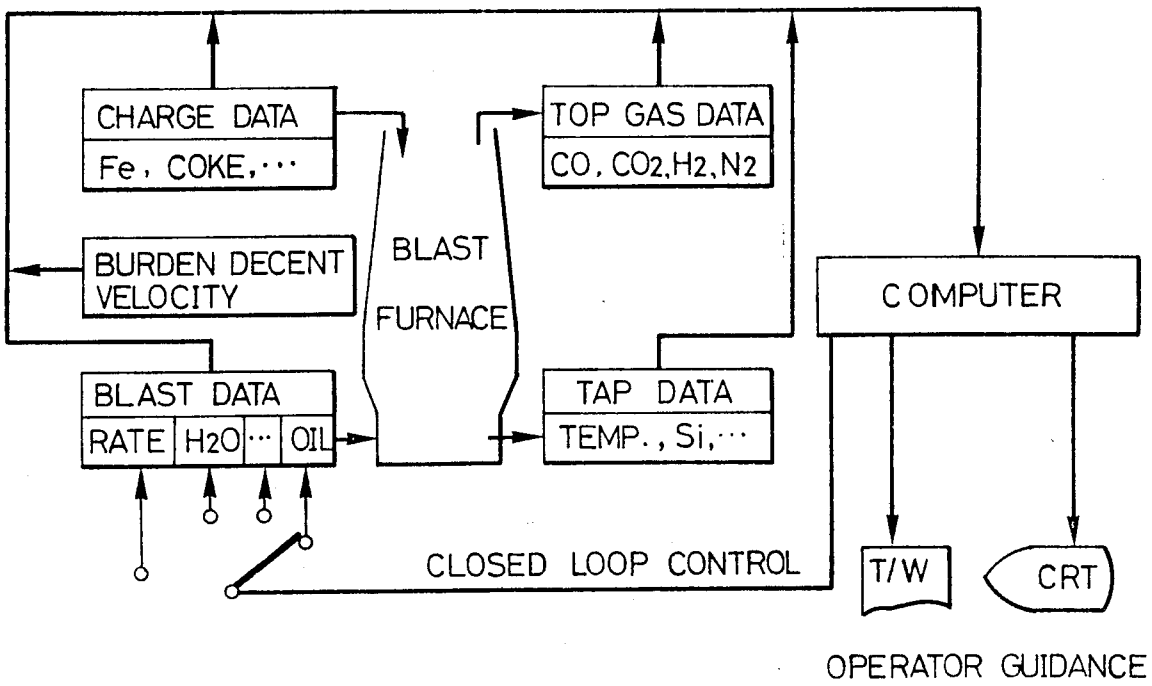

As has been described in the foregoing, the method of control according to the invention is characterized in that a control method which has hitherto been practiced by operations having rich experience in the art by taking actual hot metal temperature, top gas analysis values and past manipulating variable values into consideration is described as a systematic model to permit precise control, and it permits automatic control of a blast furnace by a computor system as shown in FIG. 1.

What is claimed:

1. A method of controlling blast furnace operation by changing the value of the following manipulating variables: oil injection rate, blast moisture, blast oxygen rate, blast rate, blast temperature and ore/coke ratio, the method comprising:

(A) assuming a process model on the basis of the following conditions:

(1) the working volume in the furnace is vertically subdivided into a plurality of horizontal zone, (2) in each zone, predetermined reactions proceed uniformly, and (3) said horizontal zones include a zone at the lower side in which carbon solution reaction (R4) and pig iron production reaction (R5) proceed;

$$C+CO_2 \rightarrow 2CO \quad (R4)$$

$$FeO+CO \rightarrow Fe+CO_2 \quad (R5)$$

(B) conducting measurements and analyses to obtain the following process data: the charge data, top gas data, blast data and tap data.

(C) predicting the future temperature $\hat{T}i$ of the i-th zone by the steps of:

(1) calculating the reaction rates R4 and R5 at present from said process data, (2) predetermining the step response characteristic of the reaction rates R4 and R5 when changing the values of the maniplating variables, (3) calculating the future reaction rates $\hat{R}4$ and $\hat{R}5$ from the present reaction rates R4 and R5 and said step response characteristics, (4) calculating the other future reaction rates $\hat{R}m$ from the future reaction rates $\hat{R}4$ and $\hat{R}5$ and the manipulating variables, (5) calculating the future temperature $\hat{T}i$ of the i-th zone from the future reaction rates $\hat{R}m$ and the manipulating variables, on the basis of the material and heat balance equations applied to the model, (D) changing the value of at least one of the manipulating variables to control the temperature of i-th zone according to the following equation:

$$U^* = U^o + \sum_j G_u^j (Ti^* - \hat{T}i^j)$$

where

U*: value of manipulating variable after change

U°: value of manipulating variable at present time $G_u^j$: coefficient

Ti*: target temperature of i-th zone $\hat{T}i^j$: predicted temperature of i-th zone at future time j.

2. A method as claimed in claim 1, wherein the working volume of the blast furnace is assumed to consist of the upper and lower zones, the following reaction proceeding in the upper zone:

$$Fe_2O_3, Fe_3O_4 \rightarrow FeO$$

3. A method as claimed in claim 1, wherein the working volume of the blast furnace is assumed to consist of at least three zones including a preheating zone, reducing zone and carbon burning zone.

4. A method as claimed in claim 1, the method employing a process model wherein the working volume in the furnace is subdivided into five zones and the following reactions proceed therein:

the first zone; preheating of the charge the second zone;

$$3Fe_2O_3+CO \rightarrow 2Fe_3O_4+CO_2 \quad (R1)$$

the third zone;

$$C+CO_2 \rightarrow 2CO \quad (R2)$$

$$Fe_3O_4+CO \rightarrow 3FeO+CO_2 \quad (R3)$$

$$Fe_3O_4+H_2 \rightarrow 3FeO+H_2O \quad (R9)$$

$$CaCO_3 \rightarrow CaO+CO_2 \quad (R10)$$

the fourth zone;

$$FeO+CO \rightarrow Fe+CO_2 \quad (R5)$$

$$C+CO_2 \rightarrow 2CO \quad (R4)$$

the fifth zone;

$$C+\tfrac{1}{2}O_2 \rightarrow CO \quad (R6)$$

$$C+H_2O \rightarrow CO+H_2 \quad (R7)$$

$$CnHm \rightarrow nC+m/2H_2 \quad (R8)$$

5. A method of controlling blast furnace operation by changing the value of the following manipulating variables: oil injection rate, blast moisture, blast oxygen rate, blast rate, blast temperature and ore/coke ratio, the method comprising:

(A) assuming a process model on the basis of the following condition:

(1) the working volume on the furnace is vertically subdivided into a plurality of horizontal zones, (2) in each zone, predetermined reactions proceed uniformly, and (3) said horizontal zones include a zone at the lower side in which carbon solution reaction (R4) and pig iron production reaction (R5) proceed;

$$C+CO_2 \rightarrow 2CO \quad (R4)$$

$$FeO+CO \rightarrow Fe+CO_2 \quad (R5)$$

(B) conducting measurements and analyses to obtain the following process data; the charge data, top gas data, blast data and tap data, (C) calculating the temperature TSn of the solid in the lowest zone by the steps of:

(1) calculating the reaction rates Rm from the process data, and (2) calculating the temperature TSn from the process data and the reaction rates Rm on the basis of the material and heat balance equations applied to the model, (D) predicting the future temperature $\hat{T}Sn$ of the solid in the lowest zone by the steps of;

(1) predetermining the step response characteristics of the reaction rates R4 and R5 when changing the values of the manipulating variables, (2) calculating the future reaction rates $\hat{R}4$ and $\hat{R}5$ from the present reaction rates R4 and R5 and said step response characteristics, (3) calculating the future reaction rates $\hat{R}m$ of the reaction (Rm) in the zones from the future reaction rates $\hat{R}4$ and $\hat{R}5$ and the manipulating variables, (4) calculating the future temperature $\hat{T}Sn$ from the future reaction rates $\hat{R}m$, the process data and on the basis of the material and heat balance equations applied to the model, (E) predecting the future pig iron temperature $\hat{T}_{pig}$ by the following equation:

$$\hat{T}_{pig}^{j}=\hat{T}S_{n}^{j}-\delta T_{pig}^{-1}$$

$$\delta T_{pig}^{-1}=TSn^{-1}-T_{pig}^{-1}$$

wherein $\hat{T}_{pig}^{j}$: predicted temperature of pig iron tapped at future time j, $\hat{T}S_{n}^{j}$: predicted temperature of the solid in the lowest zone at future time j, $T_{pig}^{-1}$: actual pig iron temperature of the latest tap $TSn^{-1}$: calculated temperature of the solid in the lowest zone at the time of the latest tap (F) changing the value of at least one of the manipulating varialbes to control the temperature of pig iron according to the following equation;

$$U^{*} = U^{o} + \sum_{j} G_{u}^{j} (T_{pig}^{*} - \hat{T}_{pig}^{j})$$

where $U^{*}$: value of manipulating variable after the change $U^{\circ}$: value of manipulating variable at present time $G_{u}^{j}$: coefficient $T_{pig}^{*}$: target temperature of pig iron 6. A method of controlling a blast furnace operation by changing the value of the following manipulating variables; oil injection rate, blast moisture, blast oxygen rate, blast rate, blast temperature and ore/coke ratio, the method comprising:

(A) assuming a process model on the basis of the following conditions:

(1) the working volume in the furnace is vertically subdivided into a plurality of horizontal zones, (2) In each zone, predetermined reactions proceed uniformly, and (3) said horizontal zones include a zone at the lower side in which carbon solution reaction (R4) and pig iron production reaction (R5) proceed;

$$C+CO_2 \rightarrow 2CO \quad (R4)$$

$$FeO+CO \rightarrow Fe+CO_2 \quad (R5)$$

(B) conducting measurements and analyses to obtain the following process data: the charge data, top gas data, blast data and tap data.

(C) calculating the temperature TSn of the solid in the lowest zone by the steps of;

(1) calculating the reaction rates Rm from the process data, and (2) calculating the temperature TSn from the process data and the reaction rates Rm on the basis of the material and heat balance equations applied to the model, (D) predicting the future temperature $\hat{T}Sn$ of the solid in the lowest zone by the steps of:

(1) predetermining the step response characteristics of the reaction rates R4 and R5 when changing the values of the manipulating variables, (2) calculating the future reaction rates $\hat{R}4$ and $\hat{R}5$ from the present reaction rates R4 and R5 and said step response characteristics (3) calculating the future reaction rates $\hat{R}m$ of the reaction (Rm) in the zones from the future reaction rates $\hat{R}4$ and $\hat{R}5$ and the manipulating variables, (4) calculating the future temperature $\hat{T}Sn$ from the future reaction rates $\hat{R}m$, and the manipulating variables, on the basis of the material and heat balance equations applied to the model.

(E) predicting the silicon content of the pig iron tapped in future by the following equations:

$$\hat{S}i^{j}=C_1\hat{T}S_5^{j}+C_2-\delta Si^{-1}$$

$$\delta Si^{-1}=C_1TS_5^{-1}+C_2-Si^{-1}$$

wherein $Si^{j}$: predicted silicon content of the pig iron tapped at tuture time j $TSn^{j}$: predicted temperature of the solid in the lowest zone at future time j $Si^{-1}$: actual silicon content of the pig iron of the latest tap1

$TSn^{-1}$: calculated temperature of the solid in the lowest zone at the time of the latest tap $C_1$, $C_2$: constant (F) changing the value of at least one of the manipulating variables to control the silicon content of pig iron according to the following equation:

$$U^{*} = U^{o} + \sum_{k} G_{u}^{j} (Si^{*} - \hat{S}i^{j})$$

wherein $U^{*}$: value of the manipulating variable after the change $U^{\circ}$: value of the manipulating variable at present time $G_{u}^{j}$: coefficient $Si^{*}$: target silicon content of pig iron 7. A method as claimed in claims 1, 2, 3, 4, 5, or 6, the method further comprising the steps;

(1) calculating a coke consumption rate and a pig iron production rate from the process data and the reaction rate Rm, (2) calculating the burden descent velocity Vc from the coke consumption rate and the pig iron production rate, (3) measuring the actual burden descent velocity $V_R$, (4) recorrecting the value of the manipulating variable on the basis of the difference between the calculated burden descent velocity and the actual burden descent velocity.

* * * * *